US009458852B2

(12) United States Patent
Yoo et al.

(10) Patent No.: US 9,458,852 B2
(45) Date of Patent: Oct. 4, 2016

(54) CENTRIFUGAL FAN HAVING A FLOW CONTROL MEMBER

(71) Applicant: NIDEC CORPORATION, Kyoto (JP)

(72) Inventors: Seung-sin Yoo, Kyoto (JP); Tomohiro Hasegawa, Kyoto (JP); Shunji Matsumoto, Kyoto (JP); Kazuo Tanaka, Kyoto (JP); Takuro Kawano, Kyoto (JP); Yuji Katsurayama, Kyoto (JP); Atsushi Mukai, Kyoto (JP); Noriaki Yamamoto, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 709 days.

(21) Appl. No.: 13/792,760

(22) Filed: Mar. 11, 2013

(65) Prior Publication Data

US 2014/0072423 A1 Mar. 13, 2014

(30) Foreign Application Priority Data

Sep. 11, 2012 (JP) ..... 2012-199628

(51) Int. Cl.

| | |
|---|---|
| ***F04D 17/16*** | (2006.01) |
| ***F04D 29/66*** | (2006.01) |
| ***F04D 29/40*** | (2006.01) |
| ***F04D 25/06*** | (2006.01) |
| ***F04D 29/42*** | (2006.01) |

(52) U.S. Cl.

CPC ..... *F04D 17/16* (2013.01); *F04D 25/0613* (2013.01); *F04D 29/4226* (2013.01); *F04D 29/667* (2013.01)

(58) Field of Classification Search

CPC ..... F01D 17/16–17/167; F01D 25/04; F01D 25/243; F04D 29/4226; F04D 29/667; F04D 1/00–1/14; F05D 2240/14

USPC ..... 415/203–206

See application file for complete search history.

(56) References Cited

U.S. PATENT DOCUMENTS 3,732,028 A * 5/1973 Heynemanns ..... F04D 29/4286 415/197
3,915,596 A * 10/1975 Frazar ..... B01D 53/26 277/420
4,123,968 A * 11/1978 Malott ..... F24F 7/025 248/303

(Continued)

FOREIGN PATENT DOCUMENTS

JP 2008-157216 A 7/2008

*Primary Examiner* — Thomas Denion
*Assistant Examiner* — Laert Dounis
(74) *Attorney, Agent, or Firm* — Westerman, Hattori, Daniels & Adrian, LLP

(57) ABSTRACT

A centrifugal fan includes an impeller, a motor portion, and a housing. The housing includes an upper plate portion, a lower plate portion arranged to have the motor portion fixed thereto; and a side wall portion. A flow control member is arranged to extend in a line along a boundary between an inside surface of the side wall portion and one of a lower surface of the upper plate portion and an upper surface of the lower plate portion. The flow control member includes a flow control surface arranged to extend radially outward from the one of the lower surface of the upper plate portion and the upper surface of the lower plate portion to the inside surface of the side wall portion while becoming more distant from the one of the lower surface of the upper plate portion and the upper surface of the lower plate portion.

10 Claims, 5 Drawing Sheets

(56) References Cited

U.S. PATENT DOCUMENTS 5,120,193 A * 6/1992 Kadle ..... F04D 29/663 415/119
5,997,246 A * 12/1999 Humbad ..... F04D 29/667 415/119
2002/0025252 A1* 2/2002 Gatley, Jr. ..... F01D 25/24 415/204
2004/0091352 A1* 5/2004 Gay ..... F04D 1/063 415/104
2008/0130226 A1 6/2008 Yamashita et al.
2010/0124507 A1* 5/2010 Wallace ..... F03D 11/0008 416/248

* cited by examiner

CENTRIFUGAL FAN HAVING A FLOW CONTROL MEMBER

BACKGROUND OF THE INVENTION

1. Field of the Invention

The present invention relates to a centrifugal fan.

2. Description of the Related Art

Small and high-performance electronic devices, such as notebook PCs, produce a large amount of heat at CPUs and the like inside chassis thereof. This makes it important to take measures against the heat. One common measure against the heat is to install blower fans inside the chassis to discharge the heat. Meanwhile, there has been a demand for a reduction in thickness of the notebook PCs. Accordingly, the blower fans have been required to be reduced in thickness while reducing a deterioration in air-blowing performance.

In the case where a centrifugal fan is used as such a blower fan, members each of which is made of a metal or a resin and is in the shape of a thin plate are combined together to define a housing in order to fulfill the above requirement. A fan casing described in JP-A 2008-157216, for example, is made up of a frame and a cover. The frame includes a bottom portion and a side wall portion, and is molded by die casting using a resin or an aluminum alloy. The cover is made of a resin or a metal, and is defined in the shape of a plate. The cover is fixed on the frame.

In the case where the plate in the shape of a board is attached to the side wall portion, a right-angled corner portion is defined between the side wall portion and the plate inside the housing. An air sent radially outward from an impeller stays in the corner portion. This results in a decrease in efficiency with which an air is sent out through an air outlet. Moreover, since an air current is disturbed at the corner portion, the corner portion becomes a cause for noise as well.

SUMMARY OF THE INVENTION

A centrifugal fan according to a preferred embodiment of the present invention includes an impeller centered on a central axis extending in a vertical direction; a motor portion arranged to rotate the impeller about the central axis; and a housing arranged to accommodate the impeller. The housing includes an upper plate portion arranged to cover an upper side of the impeller; a lower plate portion arranged to cover a lower side of the impeller, and arranged to have the motor portion fixed thereto; and a side wall portion arranged to cover a side of the impeller, and arranged to define an air outlet together with the upper and lower plate portions. At least one of the upper and lower plate portions includes an air inlet. The upper plate portion, the side wall portion, and the lower plate portion are arranged to together define an air channel portion arranged to surround the impeller. A boundary between an inside surface of the side wall portion and one of a lower surface of the upper plate portion and an upper surface of the lower plate portion is arranged to have a flow control member arranged thereon, the flow control member extending in a line along the boundary. The flow control member includes a flow control surface arranged to extend radially outward from the one of the lower surface of the upper plate portion and the upper surface of the lower plate portion to the inside surface of the side wall portion while becoming more distant from the one of the lower surface of the upper plate portion and the upper surface of the lower plate portion.

The centrifugal fan according to the above preferred embodiment of the present invention is able to achieve an improvement in air blowing efficiency.

DETAILED DESCRIPTION OF THE PREFERRED EMBODIMENTS

Figure 1:
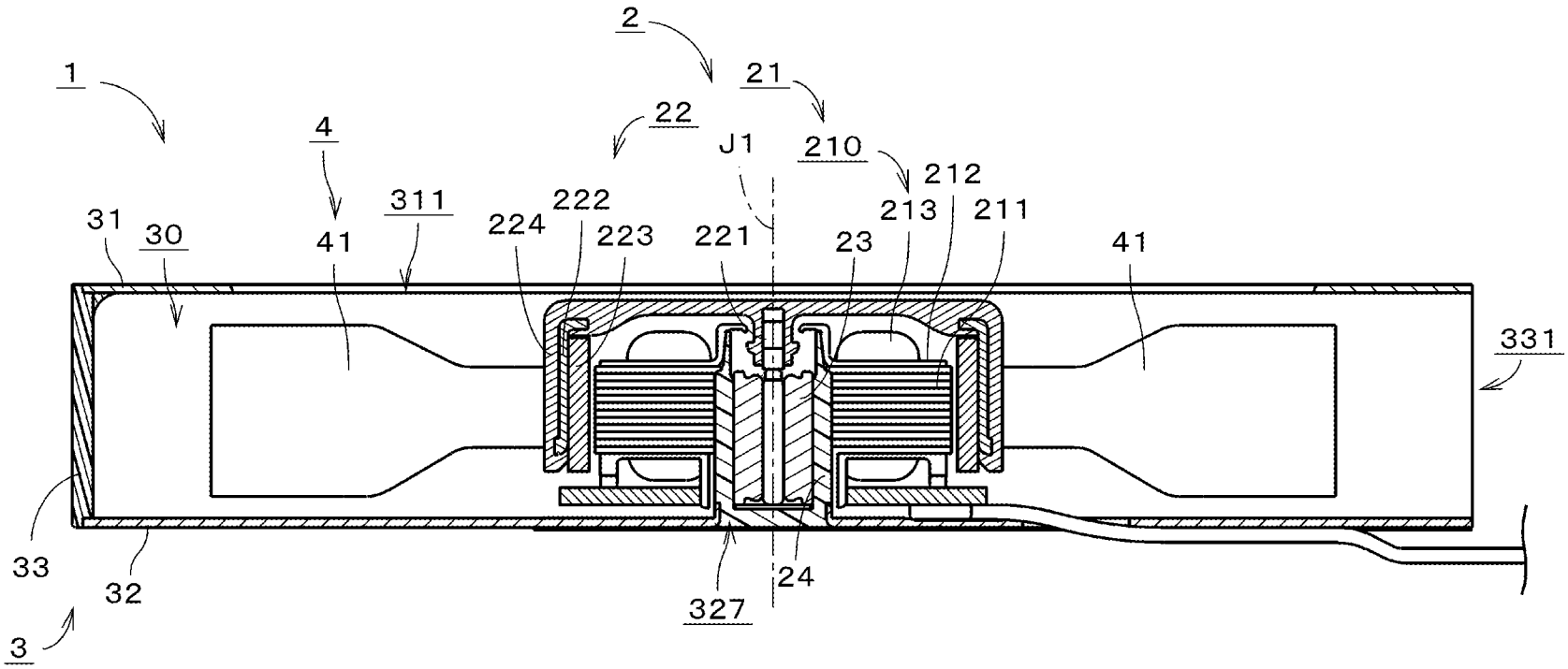
FIG. 1 is a cross-sectional view of a centrifugal fan according to a preferred embodiment of the present invention.

It is assumed herein that an upper side and a lower side in a direction parallel to a central axis a centrifugal fan illustrated in FIG. 1 are referred to simply as an upper side and a lower side, respectively. Note that a vertical direction assumed herein may not necessarily correspond with a vertical direction of the centrifugal fan when the centrifugal fan is actually installed in a device. It is also assumed herein that a circumferential direction about the central axis is simply referred to by the term "circumferential direction", "circumferential", or "circumferentially", that radial directions centered on the central axis are simply referred to by the term "radial direction", "radial", or "radially", and that the direction parallel to the central axis is simply referred to by the term "axial direction", "axial", or "axially".

FIG. 1 is a cross-sectional view of a centrifugal fan 1 according to a preferred embodiment of the present invention. The centrifugal fan 1 is, for example, installed in a notebook personal computer (hereinafter referred to as a "notebook PC"), and is used to cool devices inside a chassis of the notebook PC.

The centrifugal fan 1 includes a motor portion 2, a housing 3, and an impeller 4. The impeller 4 is centered on a central axis J1 extending in the vertical direction. The motor portion 2 is arranged to rotate the impeller 4 about the central axis J1. The housing 3 is arranged to accommodate the motor portion 2 and the impeller 4.

The housing 3 includes an upper plate portion 31, a lower plate portion 32, and a side wall portion 33. The upper plate portion 31 is arranged to cover an upper side of the impeller 4. The lower plate portion 32 is arranged to cover a lower side of the impeller 4. The motor portion 2 is fixed to the lower plate portion 32. The side wall portion 33 is arranged to cover a side of the impeller 4. The side wall portion 33 is arranged to define an air outlet 331 together with the upper and lower plate portions 31 and 32. The upper plate portion 31, the side wall portion 33, and the lower plate portion 32 are arranged to together define an air channel portion 30 arranged to surround the impeller 4.

Each of the upper and lower plate portions 31 and 32 is made of a metal, such as an aluminum alloy or stainless steel, and is defined in the shape of a thin plate. The side wall portion 33 is made of an aluminum alloy, and is molded by die casting. A lower end portion of the side wall portion 33 and an edge portion of the lower plate portion 32 are screwed and fastened to each other. The upper plate portion 31 is fixed to an upper end portion of the side wall portion 33 by crimping. The upper plate portion 31 includes an air inlet 311. The air inlet 311 is arranged above the impeller 4.

The motor portion 2 is of an outer-rotor type. The motor portion 2 includes a stationary portion 21, which is a stationary assembly, a rotating portion 22, which is a rotating assembly, and a sleeve 23, which is a bearing. The sleeve 23 is substantially cylindrical and centered on the central axis J1. The rotating portion 22 is supported by the sleeve 23 such that the rotating portion 22 is rotatable about the central axis J1 with respect to the stationary portion 21.

The stationary portion 21 includes a stator 210 and a bearing support portion 24. The bearing support portion 24 is arranged to accommodate the sleeve 23. The bearing support portion 24 is substantially cylindrical and centered on the central axis J1, and is made of a resin. The bearing support portion 24 is arranged to project upward from a substantial center of the lower plate portion 32. The bearing support portion 24 is fixed in a hole portion 327 defined in the lower plate portion 32. A lower end portion of the bearing support portion 24 and a portion of the lower plate portion 32 around the hole portion 327 are joined to each other by an insert molding process.

The stator 210 is an annular member centered on the central axis J1. The stator 210 is attached to an outside surface of the bearing support portion 24. The stator 210 includes a stator core 211, an insulator 212, and coils 213. The stator core 211 is defined by laminated silicon steel sheets, each of which is in the shape of a thin plate. The insulator 212 is made of an insulating material, and is arranged to cover a surface of the stator core 211.

The rotating portion 22 includes a shaft 221, a yoke 222, a rotor magnet 223, and a cup 224. The cup 224 has a bottom and is substantially cylindrical, and is centered on the central axis J1. The cup 224 is arranged to be open downwardly. The shaft 221 is centered on the central axis J1, and an upper end portion of the shaft 221 is fixed to the cup 224. The yoke 222 is substantially cylindrical and centered on the central axis J1, and is fixed to an inside surface of the cup 224. The rotor magnet 223 is substantially cylindrical and centered on the central axis J1, and is fixed to an inside surface of the yoke 222.

The shaft 221 is inserted in the sleeve 23. The sleeve 23 is defined by an oil-bearing porous metal body, and is inserted and fixed in the bearing support portion 24. Note that a ball bearing, for example, may be used as a bearing mechanism.

The impeller 4 includes a plurality of blades 41. The blades 41 are arranged on an outside of the cup 224 in an annular shape centered on the central axis J1. A radially inner end portion of each blade 41 is fixed to an outside surface of the cup 224. A torque centered on the central axis J1 is produced between the rotor magnet 223 and the stator 210 as a result of supply of a current to the stationary portion 21. The impeller 4 is thereby caused to rotate about the central axis J1 together with the rotating portion 22. Rotation of the impeller 4 causes an air to be drawn into the housing 3 through the air inlet 311, and to be sent out through the air outlet 331.

Figure 2:
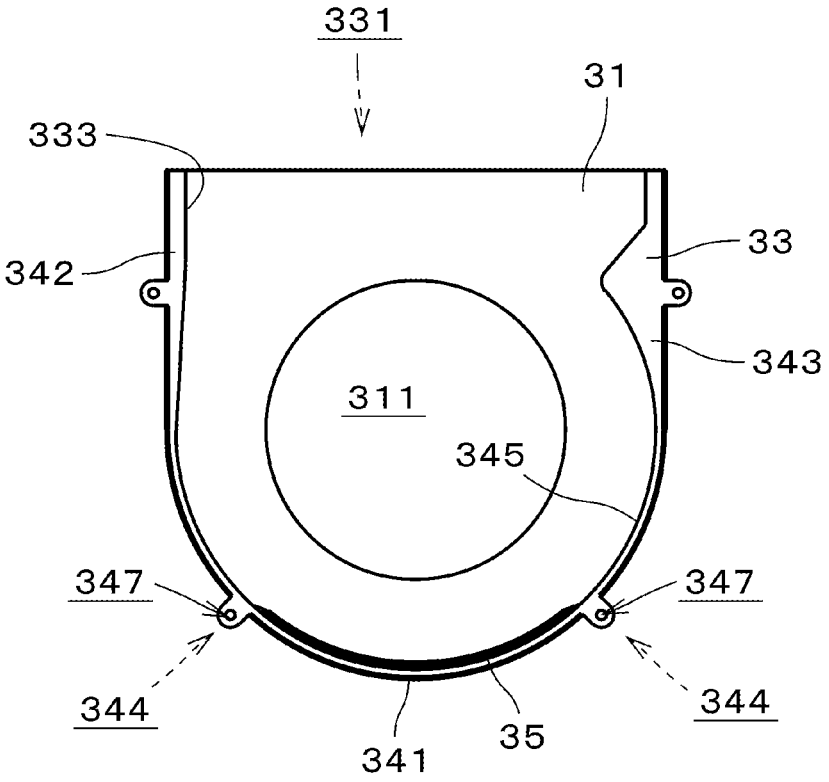
FIG. 2 is a bottom view of an assembly made up of an upper plate portion and a side wall portion according to the preferred embodiment.
Figure 3:
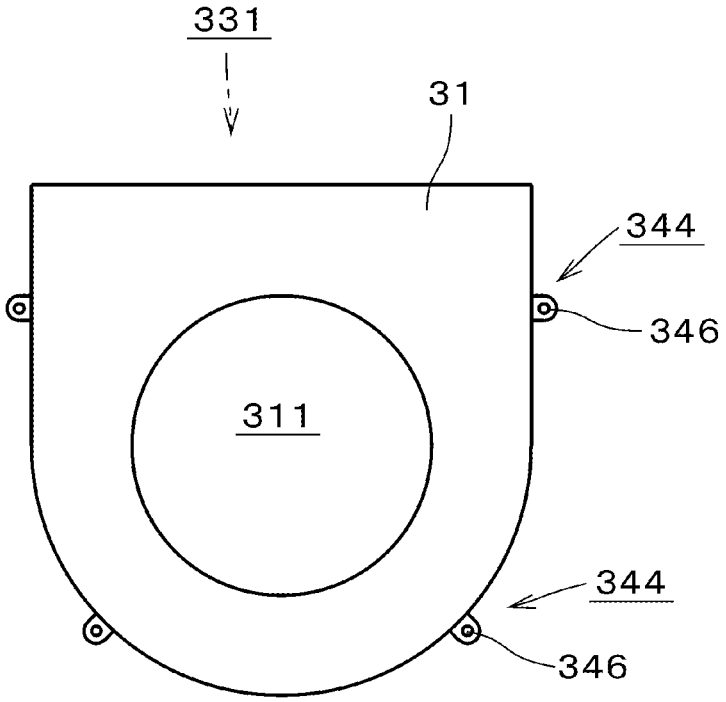
FIG. 3 is a plan view of the assembly made up of the upper plate portion and the side wall portion.

FIG. 2 is a bottom view of an assembly made up of the upper plate portion 31 and the side wall portion 33. FIG. 3 is a plan view of the assembly. The air outlet 331 is arranged on an upper side in each of FIGS. 2 and 3. The side wall portion 33 includes a first side wall portion 341, a second side wall portion 342, and a third side wall portion 343. The first side wall portion 341 is arranged on an opposite side of the air inlet 311 with respect to the air outlet 331. That is, the first side wall portion 341 is arranged on an opposite side of the impeller 4 with respect to the air outlet 331.

The first side wall portion 341 is arranged to extend in a curve along an outer circumference of the impeller 4. The first side wall portion 341 is arranged to extend in a circumferential direction about an axis displaced from the central axis J1. An inside surface of the first side wall portion 341 is also arranged to extend in a curve along the outer circumference of the impeller 4. That is, an inside surface 333 of the side wall portion 33 includes a curved surface 345 arranged to extend in a curve along the outer circumference of the impeller 4 on the opposite side of the impeller 4 with respect to the air outlet 331.

The second side wall portion 342 is arranged to extend from the first side wall portion 341 in a rotation direction of the impeller 4. The third side wall portion 343 is arranged to extend from the first side wall portion 341 in a direction opposite to the rotation direction of the impeller 4. The first side wall portion 341 is arranged to have a radial thickness smaller than the thickness of each of the second and third side wall portions 342 and 343 measured in a lateral direction in FIG. 2.

Referring to FIG. 3, the side wall portion 33 and the upper plate portion 31 are united with each other through a plurality of crimping portions 344. A portion of each crimping portion 344 which is included in the side wall portion 33 includes a projection 346 arranged to slightly project upward. A portion of the crimping portion 344 which is included in the upper plate portion 31 includes a hole portion into which the projection 346 is inserted. The projection 346 of each crimping portion 344 is inserted into the hole portion of the crimping portion 344, and the projection 346 is thereafter slightly crushed, so that the side wall portion 33 and the upper plate portion 31 are united with each other. A portion of the upper plate portion 31 around each hole portion is arranged at a level slightly lower than that of a remaining portion of the upper plate portion 31.

In the present preferred embodiment, each projection 346 is arranged on a portion of the side wall portion 33 which is arranged to project outward in a horizontal direction. Note, however, that the position of each projection 346 may be modified appropriately. In the present preferred embodiment, two of the crimping portions 344 are arranged in the first side wall portion 341, one of the crimping portions 344 is arranged in the second side wall portion 342, and one of the crimping portions 344 is arranged in the third side wall portion 343.

Referring to FIG. 2, a plurality of screw holes 347 are defined in portions of the side wall portion 33 under the projections 346. Each of the screw holes 347 is used to fasten the lower plate portion 32 and the side wall portion 33 to each other. Each screw hole 347 is arranged to be recessed upward from a lower surface of the side wall portion 33.

Referring to FIG. 2, a flow control member 35 is arranged at a boundary between a lower surface of the upper plate portion 31 and the inside surface 333 of the side wall portion 33. The flow control member 35 is arranged to extend in a line along the boundary. In the present preferred embodiment, the flow control member 35 is arranged at a boundary between the lower surface of the upper plate portion 31 and the inside surface of the first side wall portion 341. In more detail, the flow control member 35 is arranged between the two crimping portions 344 that are most distant from the air outlet 331, that is, between the two crimping portions 344 arranged in the first side wall portion 341.

Figure 4:
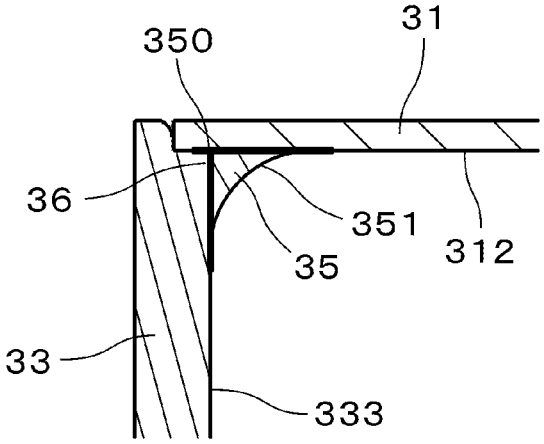
FIG. 4 is a vertical cross-sectional view of the upper plate portion, the side wall portion, and a flow control member according to the preferred embodiment.

FIG. 4 is a vertical cross-sectional view of the upper plate portion 31, the side wall portion 33, and the flow control member 35. The flow control member 35 includes a flow control surface 351 arranged to face the impeller 4. The flow control surface 351 is arranged to extend from a lower surface 312 of the upper plate portion 31 to the inside surface 333 of the side wall portion 33. The flow control surface 351 is arranged to extend radially outward and axially downward from the lower surface 312 while becoming more distant from the lower surface 312. The flow control member 35 is defined by applying an adhesive along a boundary 350 between the lower surface 312 and the inside surface 333. The adhesive used to define the flow control member 35 is made of a material that substantially functions as an adhesive, and may be made of a material that is not used as an adhesive. The flow control member 35 is preferably defined by a cured resin which has originally been fluid. This makes it easier to make the flow control member 35 have an ideal shape.

Provision of the flow control member 35 prevents a corner portion between the lower surface 312 of the upper plate portion 31 and the inside surface 333 of the side wall portion 33 from forming a right angle, and causes the lower surface 312 and the inside surface 333 to be joined to each other smoothly. This contributes to reducing a disturbance in an air which has been sucked in through the air inlet 311 by the impeller 4 and is now traveling radially outward, and smoothening a circumferential flow of the air. This results in an improved air blowing efficiency of the centrifugal fan 1. Moreover, the flow control surface 351 is arranged to be concave, being recessed toward the boundary 350, and this leads to an additional improvement in the air blowing efficiency of the centrifugal fan 1.

The flow control member 35 is bonded to both the lower surface 312 of the upper plate portion 31 and the inside surface 333 of the side wall portion 33. Here, the flow control member 35 being "bonded" to both the lower surface 312 and the inside surface 333 means that the flow control member 35 is so firmly adhered to both the lower surface 312 and the inside surface 333 that the flow control member 35 is not easily detached from the lower surface 312 or the inside surface 333. This bonding contributes to reducing vibrations of the upper plate portion 31 and the side wall portion 33. In particular, vibrations tend to occur with a high probability at an area between the two crimping portions 344 that are most distant from the air outlet 331, and provision of the flow control member 35 in this area leads to an effective reduction in the vibrations of the upper plate portion 31 and the side wall portion 33. Moreover, since crimping is additionally used to unite the upper plate portion 31 and the side wall portion 33 with each other, the upper plate portion 31 and the side wall portion 33 are firmly united with each other.

Note that the two crimping portions 344 that are most distant from the air outlet 331 refer to the most distant crimping portion 344 and the second most distant crimping portion 344. In other words, the two crimping portions 344 that are most distant from the air outlet 331 refer to a pair of adjacent ones of the crimping portions 344 in the side wall portion 33 that is most distant from the air outlet 331. Also note that, in the case where the air outlet 331 is a straight line in a plan view, the distance between the air outlet 331 and each crimping portion 344 refers to the distance between the straight line and the crimping portion 344, whereas in the case where the air outlet 331 is a curve in the plan view, the distance between the air outlet 331 and each crimping portion 344 refers to the distance between a straight line which is an approximation obtained by a least squares method or the like and the crimping portion 344.

According to the present preferred embodiment, because the first side wall portion 341 is thinner than each of the second and third side wall portions 342 and 343, the first side wall portion 341 tends to easily become a cause for vibrations. Even with this structure, provision of the flow control member 35 at a boundary between the upper plate portion 31 and the first side wall portion 341 reduces the vibrations effectively.

An oil-repellent agent is applied along the boundary 350 to define an oil-repellent film 36. A portion of the oil-repellent agent enters into a gap between the upper plate portion 31 and the side wall portion 33. In FIG. 4, the oil-repellent film 36 existing on the boundary 350 is represented by a thick line. At the time of application of the adhesive, the oil-repellent film 36 serves to prevent the adhesive from leaking out of the housing 3. The flow control member 35 is bonded to the lower surface 312 of the upper plate portion 31 radially outside a radially inner edge of the oil-repellent film 36. The flow control member 35 is bonded to the inside surface 333 of the side wall portion 33 axially above an axially lower edge of the oil-repellent film 36. That is, the oil-repellent film 36 is arranged to intervene between the entire flow control member 35 and each of the lower surface 312 and the inside surface 333. The upper plate portion 31 and the side wall portion 33 are united with each other through the flow control member 35 with the above intervention of the oil-repellent film 36.

Figure 5:
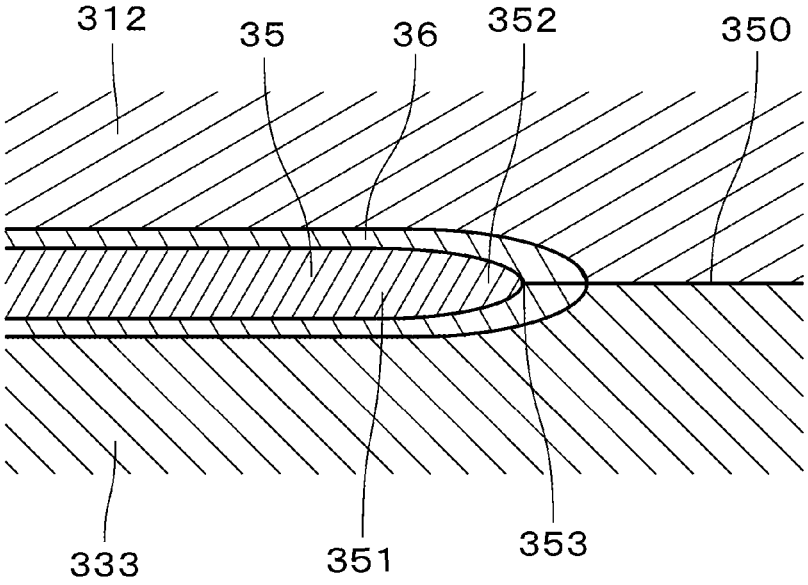
FIG. 5 is a diagram illustrating a circumferential end portion of the flow control member and its vicinity as viewed from obliquely downward according to the preferred embodiment.

FIG. 5 is a diagram illustrating a circumferential end portion 352 of the flow control member 35 and its vicinity as viewed from a direction of the impeller 4, that is, from obliquely downward. In FIG. 5, each member is hatched with parallel oblique lines. The oil-repellent film 36 is arranged to extend along the boundary 350 circumferentially outward beyond the end portion 352 of the flow control member 35, and is also arranged to extend along the boundary 350 circumferentially outward beyond an opposite end portion 352 of the flow control member 35. This contributes to preventing the adhesive from leaking out of the housing 3 through an end portion of the oil-repellent film 36 at the time of the application of the adhesive.

The width of the flow control member 35 is arranged to gradually decrease toward an end point 353 at each end portion 352. The width of the flow control member 35 refers to the width of the flow control surface 351 in a section taken along a plane perpendicular to the boundary 350. The flow control surface 351 is accordingly arranged to approach the boundary 350 with decreasing distance from the end point 353. The flow control member 35 having such a shape contributes to reducing a disturbance in an air current at the end portion 352, and thereby preventing a decrease in the air blowing efficiency.

While preferred embodiments of the present invention have been described above, it is to be understood that the present invention is not limited to the above-described preferred embodiments, and that a variety of modifications are possible.

Although the flow control member 35 is arranged between the two crimping portions 344 in the first side wall portion 341 according to the above-described preferred embodiment, the arrangement of the flow control member 35 may be modified appropriately. For example, the flow control member 35 may be arranged to extend over the entire first side wall portion 341, or may be arranged to extend from the first side wall portion 341 into the second side wall portion 342 or the third side wall portion 343. That is, at least a portion of the flow control member 35 is arranged to extend along a boundary between the lower surface 312 of the upper plate portion 31 and the curved surface 345 of the side wall portion 33 illustrated in FIG. 2. This leads to an effective improvement in the air blowing efficiency.

Note that the air inlet may be defined in the lower plate portion 32. That is, the air inlet is defined in the upper plate portion 31 or the lower plate portion 32. The wording "the upper plate portion 31 or the lower plate portion 32" here means "at least one of the upper plate portion 31 and the lower plate portion 32". Since provision of the air inlet reduces rigidity of the plate portion in which the air inlet is defined, it is preferable that the flow control member 35 should be arranged at the boundary between the inside surface 333 of the side wall portion 33 and the lower surface 312 of the upper plate portion 31 in the case where the air inlet is defined in the upper plate portion 31, and at a boundary between the inside surface 333 of the side wall portion 33 and an upper surface of the lower plate portion 32 in the case where the air inlet is defined in the lower plate portion 32. This contributes to reducing the vibrations. Note that the flow control member 35 may be arranged at a boundary between the side wall portion 33 and the plate portion in which the air inlet is not defined.

A structure in which the flow control member 35, made of the adhesive, is arranged at the boundary between the upper surface of the lower plate portion 32 and the inside surface 333 of the side wall portion 33 is also suitable for a reduction in the vibrations in the case where the lower plate portion 32 and the side wall portion 33 are united with each other by crimping.

Note that the flow control member 35 may be arranged at each of the boundary between the lower surface 312 of the upper plate portion 31 and the inside surface 333 of the side wall portion 33 and the boundary between the upper surface of the lower plate portion 32 and the inside surface 333 of the side wall portion 33. Also note that the flow control member 35 may be a member separately molded of a material other than the adhesive, e.g., a resin. In this case, the flow control member 35 is arranged on the boundary 350 through an adhesive or the like.

Note that the flow control surface 351 may not necessarily assume a concave shape in a vertical section taken along a plane including the central axis J1. For example, the flow control surface 351 may assume a straight line in the vertical section.

Also note that the oil-repellent film 36 may be omitted if the oil-repellent film 36 is not necessary to prevent the adhesive from leaking out of the housing 3. Also note that the oil-repellent film 36 may be replaced with another material.

Centrifugal fans according to preferred embodiments of the present invention are usable to cool devices inside chassis, for example, of notebook PCs and desktop PCs, to cool other devices, to supply an air to a variety of objects, and so on. Moreover, centrifugal fans according to preferred embodiments of the present invention are also usable for other purposes.

Features of the above-described preferred embodiments and the modifications thereof may be combined appropriately as long as no conflict arises.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A centrifugal fan comprising:

an impeller centered on a central axis extending in a vertical direction;

a motor portion arranged to rotate the impeller about the central axis; and a housing arranged to accommodate the impeller; wherein the housing includes:

an upper plate portion arranged to cover an upper side of the impeller;

a lower plate portion arranged to cover a lower side of the impeller, and arranged to have the motor portion fixed thereto; and a side wall portion arranged to cover a side of the impeller, and arranged to define an air outlet together with the upper and lower plate portions;

at least one of the upper and lower plate portions includes an air inlet;

the upper plate portion, the side wall portion, and the lower plate portion are arranged to together define an air channel portion arranged to surround the impeller;

a boundary between an inside surface of the side wall portion and one of a lower surface of the upper plate portion and an upper surface of the lower plate portion is arranged to have a member arranged thereon, the member extending in a line along the boundary; and the member includes a flow control surface arranged to extend radially outward from the one of the lower surface of the upper plate portion and the upper surface of the lower plate portion to the inside surface of the side wall portion while becoming more distant from the one of the lower surface of the upper plate portion and the upper surface of the lower plate portion wherein the side wall portion includes:

a first side wall portion arranged to extend in a curve along an outer circumference of the impeller on an opposite side of the impeller with respect to the air outlet;

a second side wall portion arranged to extend from the first side wall portion in a rotation direction of the impeller; and a third side wall portion arranged to extend from the first side wall portion in a direction opposite to the rotation direction of the impeller;

the member is arranged on a boundary between an inside surface of the first side wall portion and the one of the lower surface of the upper plate portion and the upper surface of the lower plate portion; and the first side wall portion is arranged to have a thickness smaller than that of each of the second and third side wall portions.

2. The centrifugal fan according to claim 1, wherein the inside surface of the side wall portion includes a curved surface arranged to extend in a curve along an outer circumference of the impeller on an opposite side of the impeller with respect to the air outlet.

3. The centrifugal fan according to claim 1, wherein, at both end portions of the member in a circumferential direction about the central axis, the flow control surface is arranged to approach the boundary while gradually decreasing in width with decreasing distance from circumferential end points of the member.

4. The centrifugal fan according to claim 1, wherein the flow control surface is arranged to be concave, being recessed toward the boundary.

5. The centrifugal fan according to claim 1, wherein the member is bonded to both the inside surface of the side wall portion and the one of the lower surface of the upper plate portion and the upper surface of the lower plate portion.

6. The centrifugal fan according to claim 1, wherein the member is defined by a cured resin which has originally been fluid.

7. The centrifugal fan according to claim 1, further comprising an oil-repellent film arranged on the boundary, wherein the oil-repellent film is arranged to extend circumferentially outward beyond each of both end portions of the member in a circumferential direction about the central axis.

8. The centrifugal fan according to claim 7, wherein the oil-repellent film is arranged to intervene between the entire member and each of the inside surface of the side wall portion and the one of the lower surface of the upper plate portion and the upper surface of the lower plate portion.

9. The centrifugal fan according to claim 1, wherein the side wall portion and one of the upper and lower plate portions which includes the one of the lower surface of the upper plate portion and the upper surface of the lower plate portion are united with each other through a plurality of crimping portions; and the member is arranged between two of the crimping portions that are most distant from the air outlet.

10. The centrifugal fan according to claim 1, wherein the air inlet is defined in the upper plate portion, and the one of the lower surface of the upper plate portion and the upper surface of the lower plate portion is the lower surface of the upper plate portion.

* * * * *